US007955488B2

(12) United States Patent
Tsai et al.

(10) Patent No.: US 7,955,488 B2
(45) Date of Patent: Jun. 7, 2011

(54) PROCESS OF ELECTRODEPOSITION PLATINUM AND PLATINUM-BASED ALLOY NANO-PARTICLES WITH ADDITION OF ETHYLENE GLYCOL

(75) Inventors: Ming-Chi Tsai, Hsinchu (TW); Chuen-Horng Tsai, Hsinchu (TW); Tsung-Kuang Yeh, Hsinchu (TW)

(73) Assignee: National Tsing Hua University, Hsinchu (TW)

( * ) Notice: Subject to any disclaimer, the term of this patent is extended or adjusted under 35 U.S.C. 154(b) by 955 days.

(21) Appl. No.: 11/783,758

(22) Filed: Apr. 12, 2007

(65) Prior Publication Data

US 2008/0251390 A1 Oct. 16, 2008

(51) Int. Cl.
*C25D 3/50* (2006.01)
*C25D 3/52* (2006.01)

(52) U.S. Cl. ..... 205/264; 205/255; 205/256; 205/257

(58) Field of Classification Search ..... 205/264, 205/255, 256, 257
See application file for complete search history.

(56) References Cited

U.S. PATENT DOCUMENTS

| | | | | |
|---|---|---|---|---|
| 6,562,204 | B1 * | 5/2003 | Mayer et al. | 204/229.9 |
| 2007/0270305 | A1 * | 11/2007 | Pak et al. | 502/172 |
| 2007/0289409 | A1 * | 12/2007 | Xia et al. | 75/370 |
| 2008/0003155 | A1 * | 1/2008 | Jia et al. | 423/213.5 |
| 2008/0241642 | A1 * | 10/2008 | Iordache et al. | 429/44 |

* cited by examiner

*Primary Examiner* — Bruce F Bell
(74) *Attorney, Agent, or Firm* — Rosenberg, Klein & Lee

(57) ABSTRACT

An electrodeposition process of platinum and platinum-based alloy nano-particles with addition of ethylene glycol is disclosed. An acidic solution which contains metal chloride includes at least one platinum-based chloride and the alloy thereof, and ethylene glycol are introduced into a reactor as an electrodeposition solution. By applying an external negative potential, platinum particles or platinum-based alloy particles are deposited on the substrate. The above acidic solution is able to provide ionic conductivity during electrodeposition. The added ethylene glycol effectively enhances the removal of chlorine from metal chlorides. Meanwhile, ethylene glycol is used as stabilizer to prevent the particles from aggregation onto the substrate, thereby increasing the dispersion of deposited particles.

11 Claims, 10 Drawing Sheets

(b) CC4

(a) CC3

PROCESS OF ELECTRODEPOSITION PLATINUM AND PLATINUM-BASED ALLOY NANO-PARTICLES WITH ADDITION OF ETHYLENE GLYCOL

BACKGROUND OF THE PRESENT INVENTION

1. Field of the Invention

The present invention generally relates to a process of electrodepositing platinum and platinum-based alloy nanoparticles using an electrodeposition solution containing ethylene glycol.

2. Description of the Related Art

Currently, petroleum is regarded as the world's major energy source. However, as petroleum is a finite resource which is rapidly being depleted, most experts in the industry expect an energy crisis within the next 50 years. High oil prices will greatly impact industries which rely upon petroleum based energy such as industrial electricity production, domestic electricity production, vehicle power, consumer electronics, and mobile communication devices. National and international groups have been searching for alternative energy sources and hydrogen is regarded as one of the more interesting alternatives. Low-temperature fuel cells operated at temperatures of lower than 100° C. include proton exchange membrane fuel cells (PEMFCs) and direct methanol fuel cells (DMFCs). As 3C products have taken on increasingly powerful functions, the requirements of portable energy supplies have become increasingly high. For example, most consumers now insist that their 3C products should be lightweighted, have high energy density, last a long time and be convenient to use. Therefore, low-temperature fuel cells have drawn great attention as substitutes for lithium batteries.

PEMFCs utilize an environmentally friendly electrochemical reaction of hydrogen and oxygen. However, the generation, storage, and transport of hydrogen lead to a big issue to resolve for PEMFCs. In recent years, the development of DMFCs along with PEMs has reached a revolutionary breakthrough in the field of small-power technology. DMFCs have smaller power densities compared to hydrogen-fed PEMFCs. So far it is known that DMFCs have an optimal power density that is only one tenth of hydrogen-fed PEMFCs. Since DMFCs have low power densities, they are suitable for applications in compact portable electronic products, such as laptops, personal digital assistants, and mobile phones. A typical DMFC membrane electrode assembly (MEA) includes a proton exchange membrane (PEM), an electrode catalyst layer, and an electrically conductive layer. DMFCs can convert chemical energy from the liquid methanol fuel into electrical energy. PEMFCs use hydrogen as a fuel source. Compared to PEMFCs, DMFCs do not need additional reformers to convert the fuel into hydrogen. Therefore, the potentially complex assembly of a DMFC can be simplified and thereby its convenience increased. Furthermore, diluted methanol can be used as a by-functional fuel without the need of an additional membrane wetting mechanism.

Currently the biggest bottleneck for the commercialization of DMFCs is their excessively low energy conversion rate. Therefore, most research has been aimed at developing a high-activity catalyst electrode.

DMFCs have a theoretical voltage of 1.18V at 298 K. This voltage value can be obtained from half reactions at the cathode and the anode.

Anode: $CH_3OH+H_2O \rightarrow CO_2+6H^++6e^-$ $E^o_{anode}=0.05\ V_{SHE}$

Cathode: $3/2O_2+6H^++6e^- \rightarrow 3H_2O$ $E^o_{cathode}=1.23\ V_{SHE}$

Total reaction: $CH_3OH+H_2O+3/2O_2 \rightarrow CO_2+3H_2O$ $E^o_{cell}=1.18\ V_{SHE}$ The electrochemical reactions for the above cathode and anode usually need the catalysts to reduce the energy barrier for the reaction so as to speed up the oxidization reaction at the anode and the reduction reaction at the cathode. Among various precious metal catalysts, platinum has optimal activity for the oxidization of methanol fuel at the anode and the reduction of oxygen at the cathode. Therefore, most current research is made based on the condition of using Pt as an electrode catalyst. Detailed reactions are listed below:

$$Pt+CH_3OH \rightarrow Pt—CO_{ad}+4H^++4e^- \quad (a)$$

$$H_2O+Pt \rightarrow Pt—OH+H^++e^- \quad (b)$$

$$Ru+H_2O \rightarrow Ru—OH+H^++e^- \quad (c)$$

$$Pt—CO+Ru—OH \rightarrow Pt+Ru+CO_2+H^++e^- \quad (d)$$

$$Pt—CO_{ad}+Pt—OH_{ad} \rightarrow CO_2+H^++e^- \quad (e)$$

$$Pt—CHO_{ad}+Ru—OH_{ad} \rightarrow CO_2+2H^++2e^- \quad (f)$$

Methanol absorbs onto the Pt surface to generate CO through a series of de-proton steps (reaction (a)). CO molecules tend to strongly adsorbed on the entire Pt surface to reduce the amount of active sites for catalysis, leading to cell power deterioration. This phenomenon is well known as CO poisoning. If platinum-ruthenium (Pt—Ru) is used for catalysis, a Pt—Ru catalyst in alloy form can effectively reduce CO poisoning. First, the Ru reacts with water molecules to form an Ru—OH (reaction (c)). This Ru—OH compound then triggers a neighboring $Pt—CO_{ad}$ to induce CO oxidation and form a carbon dioxide molecule (reaction (d)). If $Pt—CHO_{ad}$ is formed, a similar reaction can proceed as well (reaction (f)). There is a need to develop a platinum-based catalyst which increases the reaction efficiency of methanol oxidation at the anode of a DMFC.

Furthermore, the electrons generated from methanol oxidation at the anode flow to the cathode through an external loop to provide electric power. Simultaneously, the protons transported through the PEM reacts with oxygen at the cathode to form water (in most of the cases, platinum is used as catalyst). The reasons why the catalyst at the cathode has poor electrochemical activity may be due to the reactions as follows.

$$O_2+4H^++4e^-=H_2O\ E^o_{298°\ K}=+1.23\ V_{SHE} \quad (g)$$

$$O_2+2H^++2e^-=H_2O_2\ E^o_{298°\ K}=+0.68\ V_{SHE} \quad (h)$$

$$Pt+H_2O=Pt—O+2H^++2e^-\ E^o_{298°\ K}=+0.88\ V_{SHE} \quad (i)$$

In the electrochemical reaction at the DMFC cathode, some of the oxygen atoms will be reduced to hydrogen peroxide (reaction (h)) during the reduction of oxygen into water. The surface of the platinum will be oxidized at a higher potential (reaction (i)) so that the potential loss during the reduction reaction at the DMFC cathode is higher than 0.3V. Furthermore, many approaches, such as increasing the thickness of the PEMs or adding a carbon powder layer between the PEMs and the catalyst layer, have been proposed to overcome the problems of methanol crossover. However, those approaches tend to increase interfacial resistance for DMFCs and accordingly degrade the performance of the cell.

In general, the well-distributed and small-sized catalyst contributes to an increase in activity of the DMFC catalyst. There are two commonly-used approaches: one is to use nano-sized carbon materials as catalyst supports to enhance the dispersion of the catalysts, and the other is to change the structure control the alloy composition of the catalysts. For example, a platinum-based dual-alloy or a triple-alloy can be used as an effective catalyst. Furthermore, a nano-sized catalyst usually retains a high specific surface area and easily leads to a full utilization of the catalyst. Therefore, there is a need for nano-platinum based alloy catalysts which would increase the reaction efficiencies of methanol oxidation and oxygen reduction reactions.

Processes which are commonly used to prepare a catalyst electrode of a low-temperature fuel cell include chemical reduction and electrodeposition. In the chemical reduction process, a carbon support is basically immersed in a precursor-contained (such as Pt, Ru, W, Co, Fe, or Ni) solution for several hours. After drying processes, the carbon supported metal or alloyed catalysts are put into a furnace under argon or hydrogen at about 250-300° C. for few hours. Alternatively, hydrogen as reduction agent can be introduced into the aqueous solution for several hours. Platinum or platinum-based alloy nano-particles are deposited on the surface of the carbon supports. Basically, chemical reduction is performed at a well-controlled pH value so that the redox reaction occurs efficiently. Furthermore, the temperature of the chemical redox reaction is within the range of 60° C.-150° C. The chemical reduction for depositing a single metal such as platinum is a well-developed technique; however, adding a neutralizer, such as sodium hydroxide, for controlling the pH value is still necessary. Moreover, the time-consuming chemical reduction allows Na ions to deposit on the carbon supports, resulting in unnecessary contaminations.

When using the electrodeposition process, the particles of a single metal or multiple metals are reduced from a metal precursors (usually chlorides) contained electrolyte with acids such as sulfuric acid, nitric acid, perchloric acid, or hydrochloric acid. A potential, usually a negative potential, is applied on a conductive substrate, so that the substrate becomes negative charged (as a cathode), and a counter electrode (usually a non-polarized electrode such as a platinum electrode) becomes positive charged (as anode). Metallic ions in the solution exchange electrons with the negative substrate and are then deposited onto the substrate. However, the size of the metallic particles prepared by the most commonly used electrodeposition process at present is usually more than 20 nm, resulting in a great decrease in the specific surface area of the catalysts.

SUMMARY OF THE INVENTION

It is an object of the present invention to provide an electrodeposition process of platinum and platinum-based alloy nano-particles with addition of ethylene glycol (EG). An acidic solution which contains metal chloride containing at least one platinum-based chloride and the alloy thereof, and EG is introduced into a reactor as an electrodeposition solution. By applying an external negative potential, platinum particles or platinum-based alloy particles are deposited on the substrate. Thereby, the particles have dimensions appropriate for narrowing down to nanometer scale and have good dispersion.

In order to achieve the above and other objectives, the electrodeposition solution of the invention includes a metal chloride, containing at least one platinum-based chloride and any alloy thereof; and an acidic solution containing EG.

The invention further includes an electrodeposition process of platinum and platinum-based alloy particles with addition of EG. The process of the invention includes providing a reactor; placing an electrodeposition solution into the reactor, wherein the electrodeposition solution is an acidic solution containing EG and at least one platinum-based chloride and the alloy thereof; providing an electrically conductive substrate as a cathode and a platinum metal as an anode, and putting them into the electrodeposition solution; and applying a negative potential to deposit platinum and platinum-based alloy particles on the electrically conductive substrate.

The process of the invention is a three-electrode electrochemical process in which a saturated calomel electrode (SCE) is used as a reference electrode, and platinum metal is used as a counter electrode. Pt and Pt—Ru catalysts are deposited on the nanotube specimens (referred to as working references). The potentials can be either $-0.30\ V_{SCE}$ or $-0.45\ V_{SCE}$ (potential versus SCE). The metal precursors used in the invention are respectively $H_2PtCl_6.6H_2O$ and $RuCl_3.xH_2O$. The concentrations of EG and $H_2SO_4$ are respectively 0.5 M and 0.25 M. The electrodeposition time is 2 hours. Electrodeposition conditions for each specimen are as follows.

$$-0.30\ V_{SCE}, 0.25\ M\ H_2SO_4 + 0.5\ M\ EG + 0.2\ mM\ H_2PtCl_6.6H_2O \quad (A01)$$

$$-0.30\ V_{SCE}, 0.25\ M\ H_2SO_4 + 0.5\ M\ EG + 0.2\ mM\ H_2PtCl_6.6H_2O + 0.4\ mM\ RuCl_3.xH_2O \quad (A02)$$

$$-0.45\ V_{SCE}, 0.25\ M\ H_2SO_4 + 0.5\ M\ EG + 0.2\ mM\ H_2PtCl_6.6H_2O \quad (B01)$$

$$-0.45\ V_{SCE}, 0.25\ M\ H_2SO_4 + 0.5\ M\ EG + 0.2\ mM\ H_2PtCl_6.6H_2O + 0.4\ mM\ RuCl_3.xH_2O \quad (B02)$$

The electrodeposition solution is deoxygenated by introducing nitrogen gas prior to the electrodeposition begins. The electrodeposition is performed at normal pressure and constant temperature of 30° C. All the prepared catalyst electrodes are then rinsed by de-ionized water for several times. After the reduction and oxidization of metal precursors ($H_2PtCl_6.6H_2O$, $RuCl_3.xH_2O$) and the oxidization of EG, Pt and Pt—Ru are deposited onto the carbon nanotubes.

To provide a further understanding of the present invention, the following detailed description illustrates embodiments and examples of the present invention, this detailed description being provided only for illustration of the present invention.

DETAILED DESCRIPTION OF THE PREFERRED EMBODIMENTS

Figure 1:
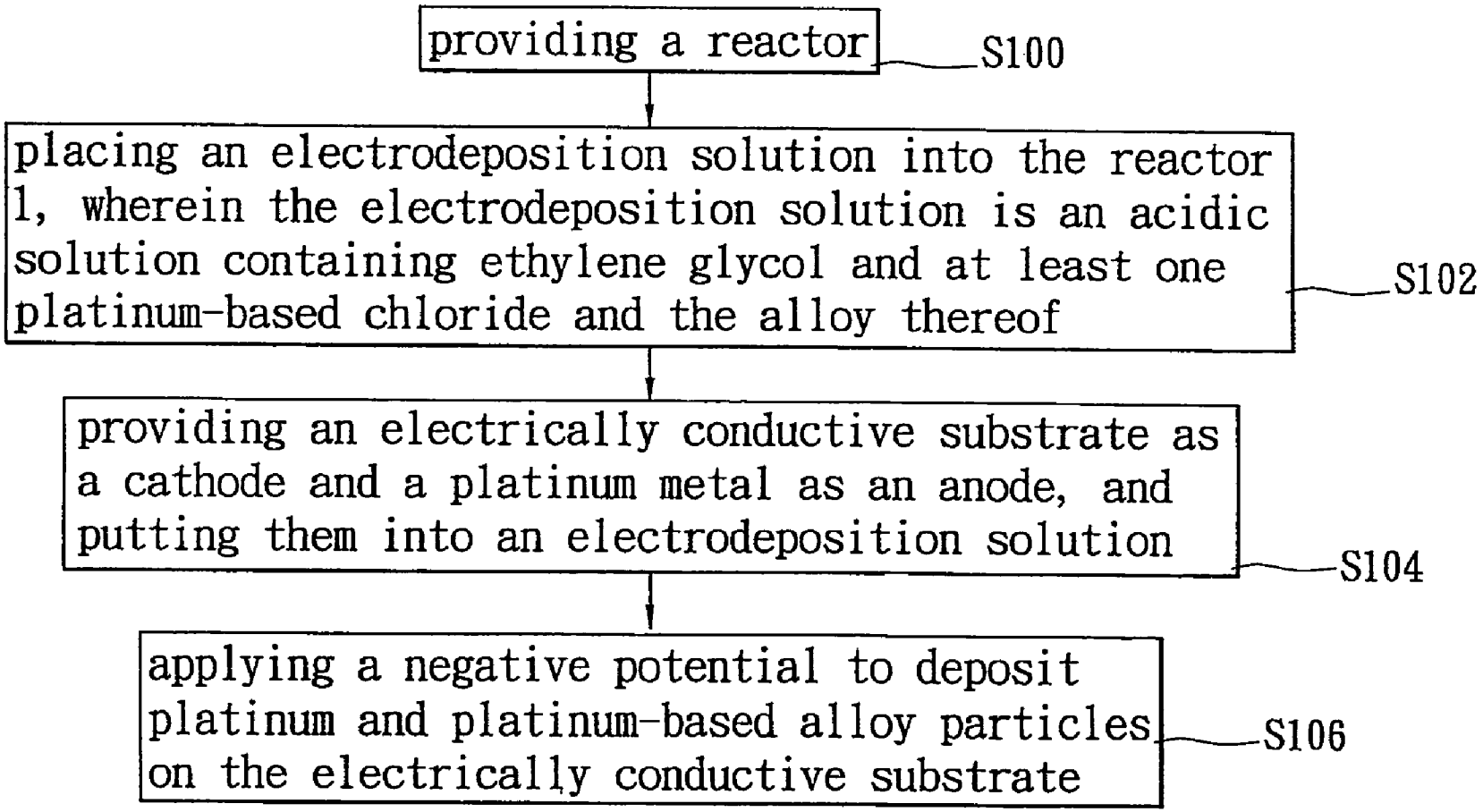
FIG. 1 is a flow chart of an electrodeposition process of Pt and Pt-based alloy particles with addition of ethylene glycol in an electrodeposition solution according to one embodiment of the invention.

Wherever possible in the following description, like reference numerals will refer to like elements and parts unless otherwise illustrated.

Figure 2:
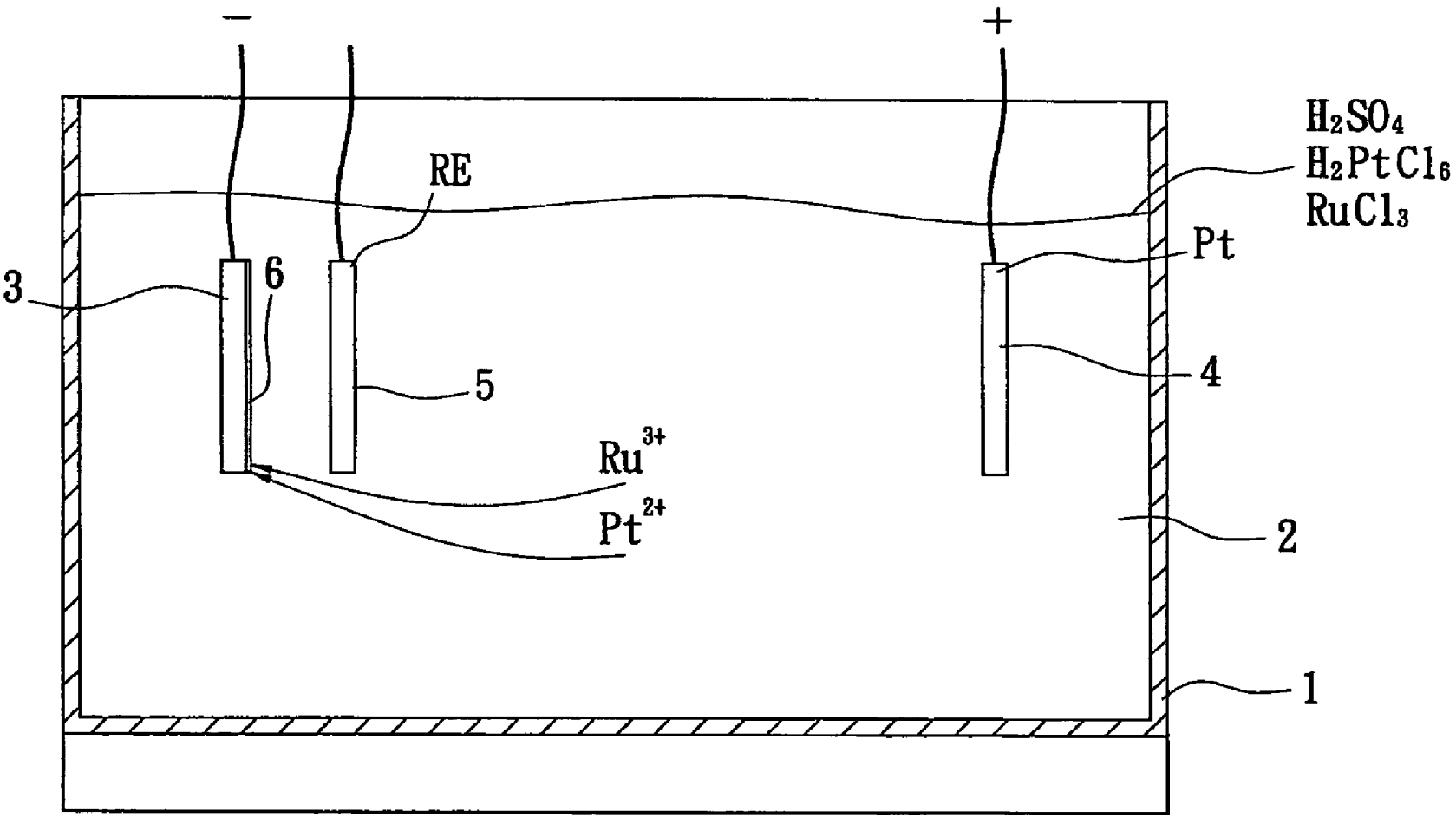
FIG. 2 is a schematic view showing an electrodeposition process of Pt and Pt-based alloy particles with addition of ethylene glycol according to one embodiment of the invention.

Referring to FIG. 1 and FIG. 2, the invention provides an electrodeposition process of platinum and platinum-based alloy nano-particles with addition of ethylene glycol in an electrodeposition solution. The process includes providing a reactor (S100); placing an electrodeposition solution 2 into the reactor 1, wherein the electrodeposition solution 2 is an acidic solution containing ethylene glycol and at least one platinum chloride and the alloy thereof (S102); providing an electrically conductive substrate 3 as a cathode and a platinum metal 4 as an anode, and putting them into the electrodeposition solution 2 (S104); and applying a negative potential to deposit platinum and platinum-based alloy particles 6 on the electrically conductive substrate 3 (S106).

The temperature of the electrodeposition solution 2 is within the range of 18-60° C. The concentration of ethylene glycol in the electrodeposition solution 2 is within the range of 0.01 M to 5 M. The ethylene glycol, on one hand, effectively enhances the removal of chlorine from the metal chloride, and on the other hand is used as a stabilizer to prevent the particles from aggregation on the substrate 3 and thus increases the dispersion of the deposited particles 6. The acidic solution is $H_2SO_4$, $HNO_3$, $HClO_4$, HCl, or $CH_3COOH$. The acidic solution in the electrodeposition solution 2 is within the range of 0.005 M to 10 M. The acidic solution offers efficient ion conductivity during electrodeposition. The platinum chloride in the electrodeposition solution 2 is within the range of 0.1 mM to 100 M.

A reference electrode 5 is further mounted in the reactor 1. The reference electrode 5 is a saturated calomel electrode, a silver/silver chloride electrode or a standard hydrogen electrode. If the potential is a pulse direct current, the potential of 1 $V_{SHE}$ to −2 $V_{SHE}$, and frequency from 0.000001 Hz to 1000000 Hz are used. If the potential is a non-pulse direct current (constant potential), the potential range is from −0.00001 $V_{SHE}$ to −2 $V_{SHE}$. The applying potential time is 1 ms to 24 h.

Figure 3B:
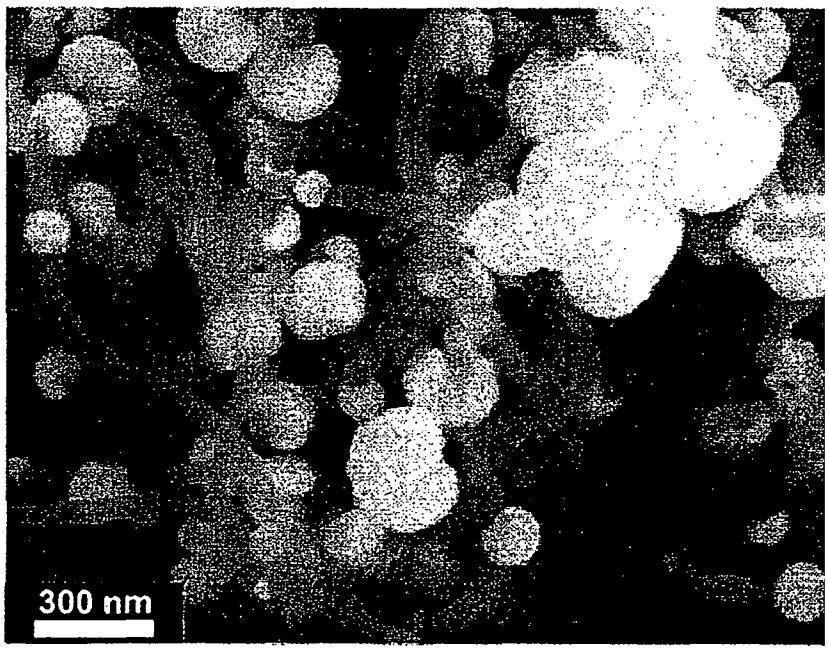
FIG. 3A and FIG. 3B are scanning electron microscopy photo showing Pt and Ru deposited onto carbon nanotubes by electrodeposition according to one embodiment of the invention.
Figure 3A:
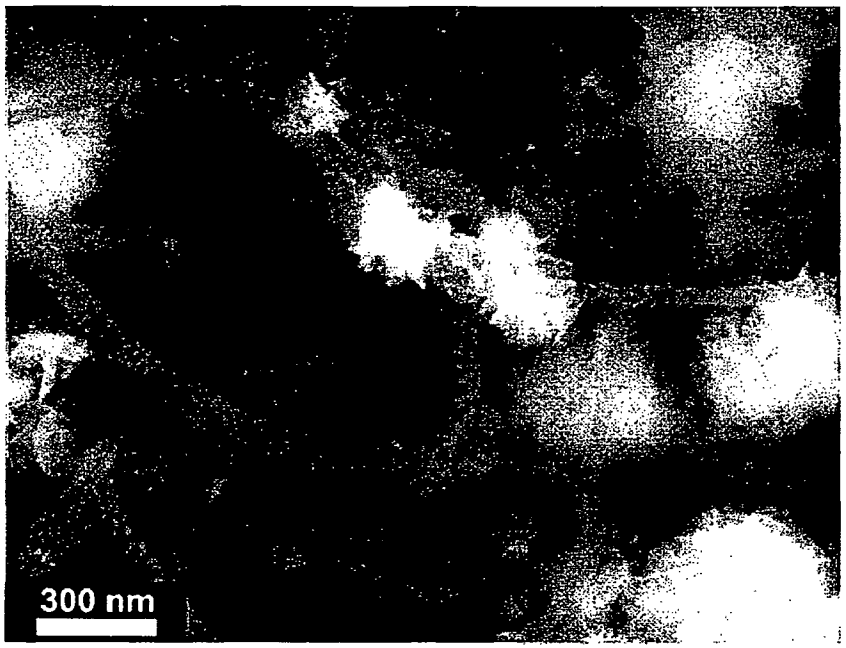
Figure 4B:
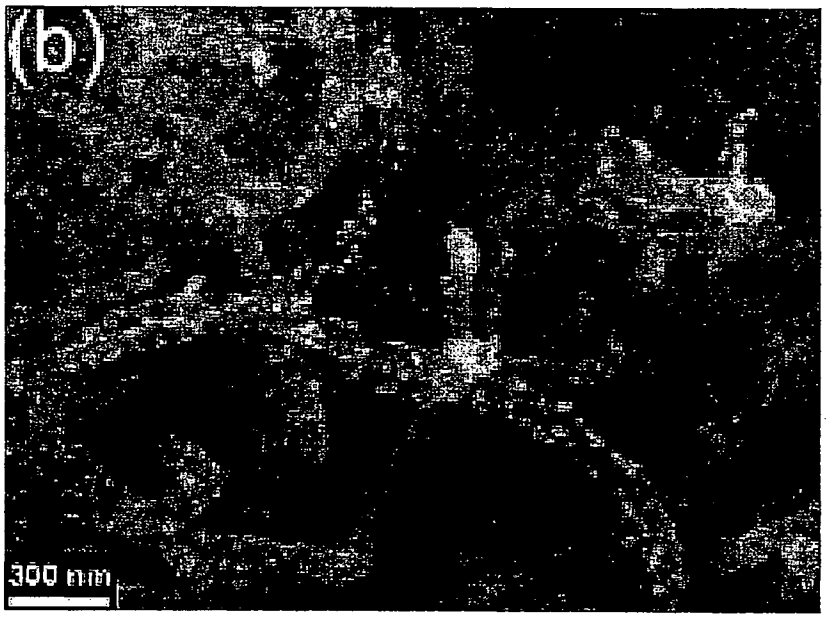
FIG. 4A to FIG. 4D are scanning electron microscopy diagrams showing Pt and Pt—Ru deposited onto carbon nanotubs by electrodeposition according to one embodiment of the invention.
Figure 4A:
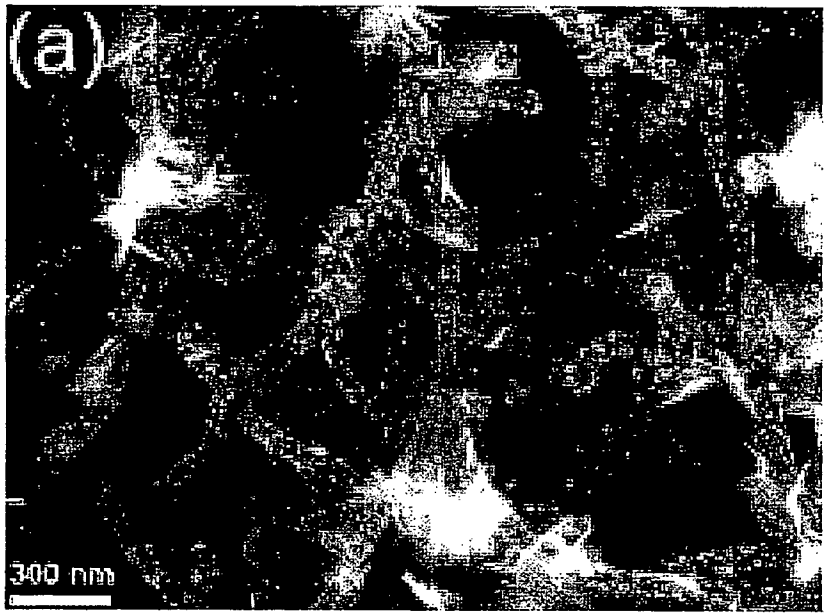
Figure 4D:
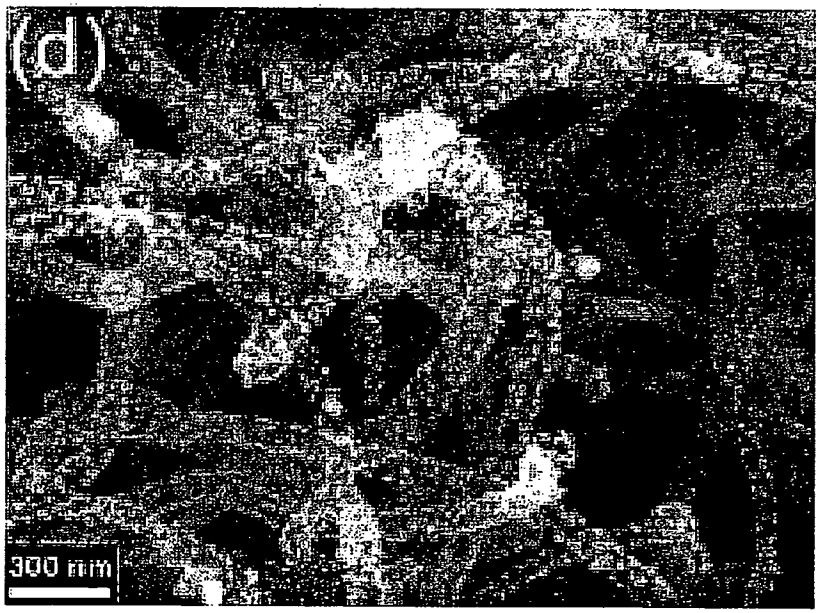
Figure 4C:
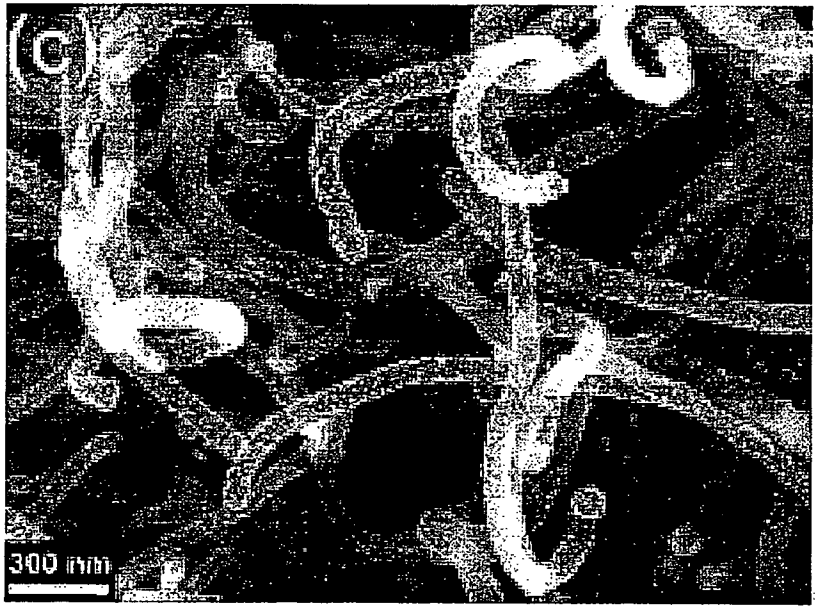
Figure 5B:
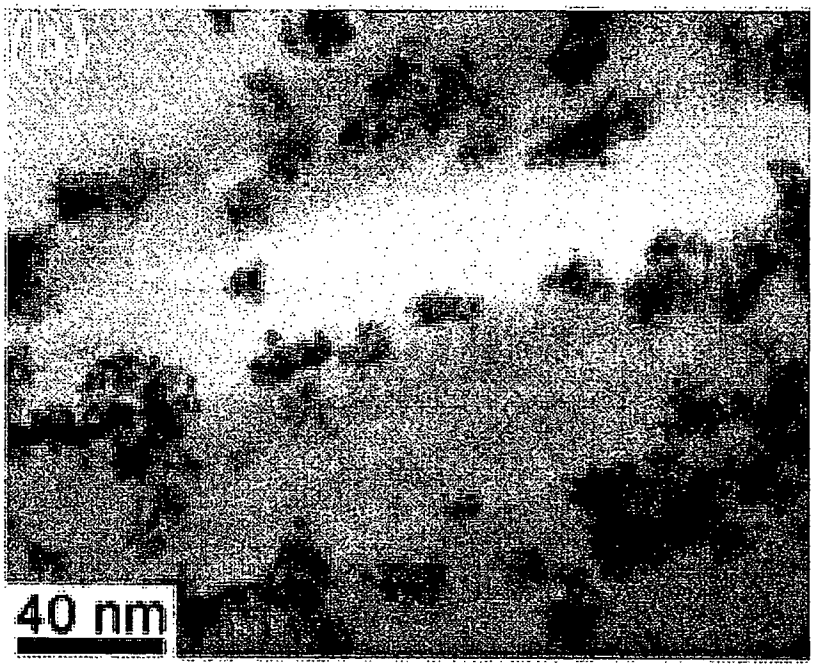
FIG. 5A to FIG. 5D are micrographs of the transmission electronic microscopy (TEM) of FIG. 4.
Figure 5A:
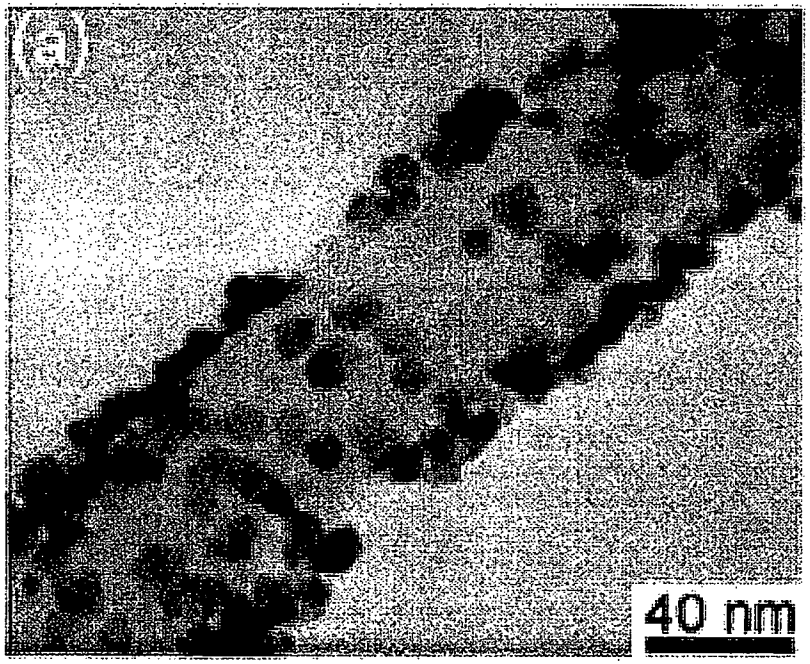
Figure 5D:
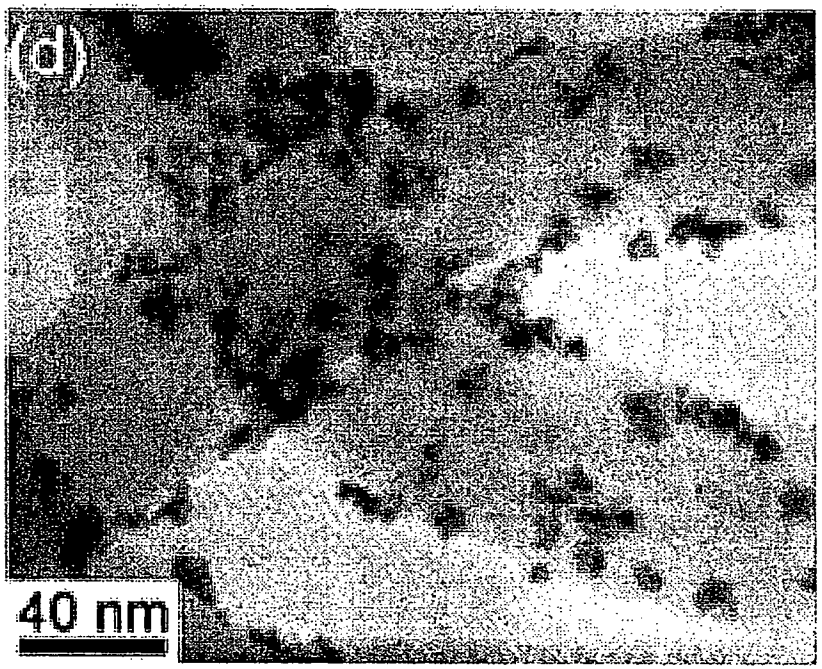
Figure 5C:
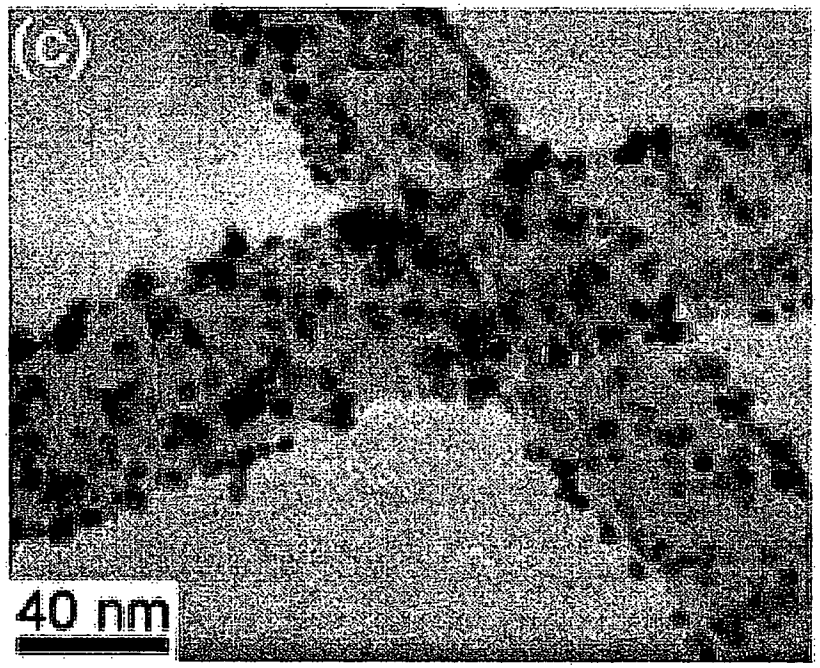
Figure 6A:
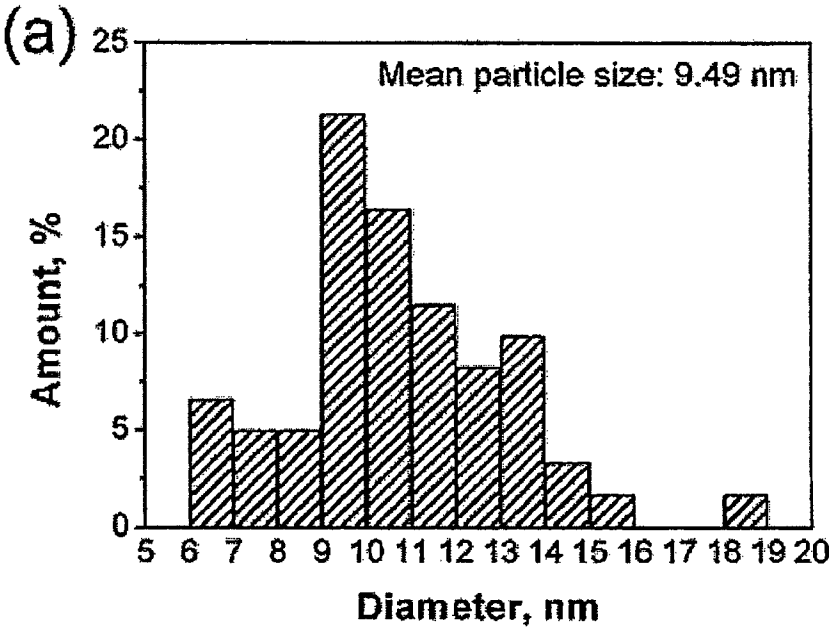
FIG. 6A to FIG. 6D illustrate distribution of particle diameter for each specimen of FIG. 5.
Figure 6B:
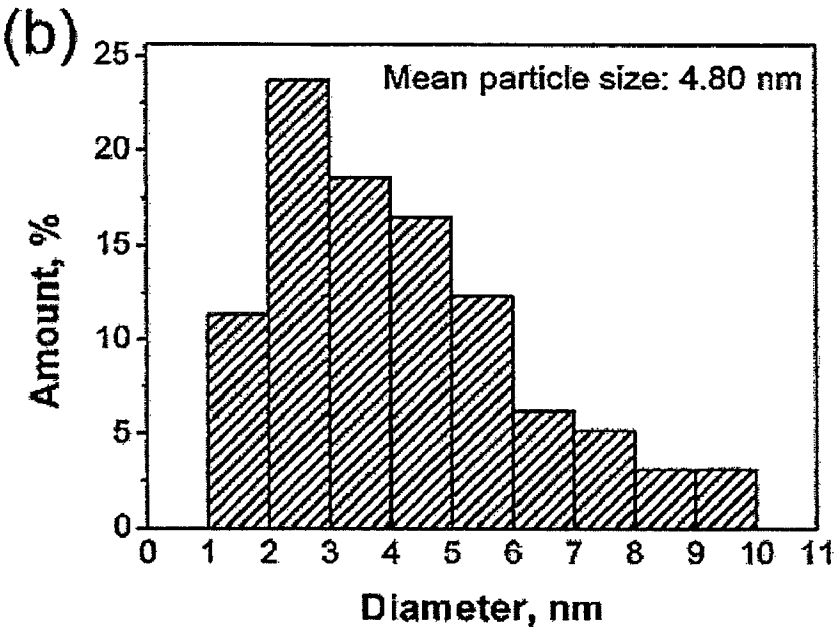
Figure 6D:
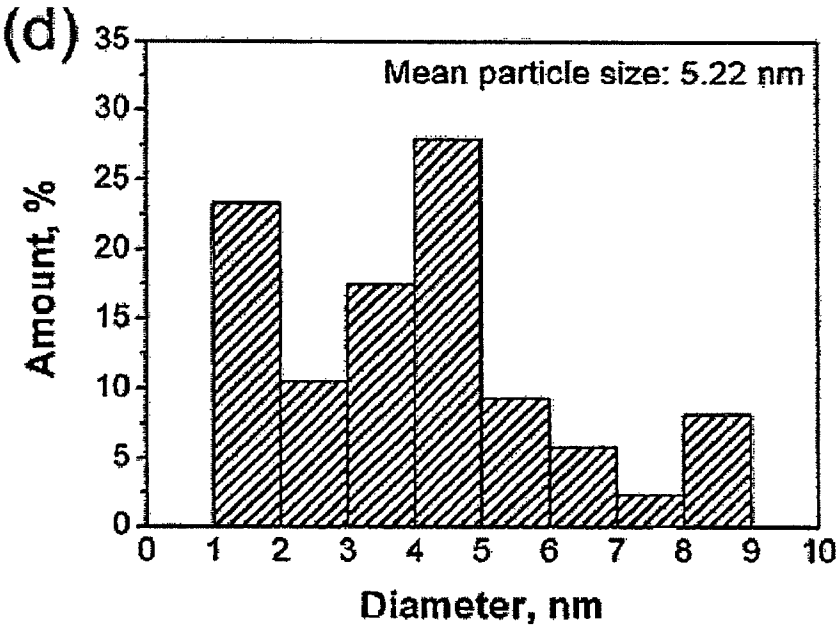
Figure 6C:
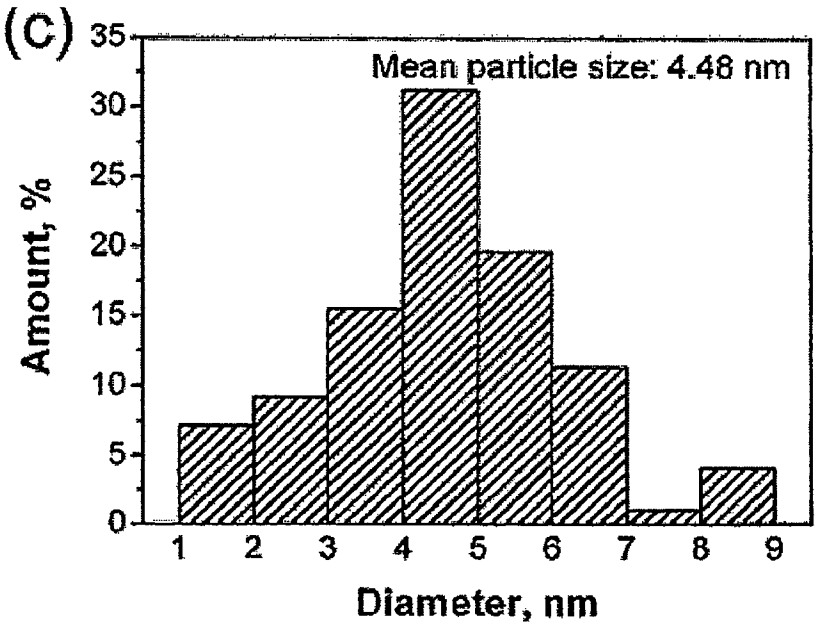

FIG. 3A and FIG. 3B are photos of scanning electron microscopy (SEM), showing that Pt and Ru are electrodeposited onto carbon nanotubes. Metal precursors used in the invention are $H_2PtCl_6.6H_2O$ and $RuCl_3.xH_2O$. 0.5 M $H_2SO_4$ is used as the electrodeposition solution in this embodiment. The electrodeposition lasts for 2 hours. Conditions for the embodiments as shown in FIG. 3A and FIG. 3B are as follows: (CC3) −0.30 $V_{SCE}$, 0.5 M $H_2SO_4$+0.2 mM $H_2PtCl_6.6H_2O$ for the embodiment as shown in FIG. 3A; and (CC4) −0.30 $V_{SCE}$, 0.5 M $H_2SO_4$+0.2 mM $H_2PtCl_6.6H_2O$+0.2 mM $RuCl_3.xH_2O$ for the embodiment as shown in FIG. 3B. In figures, white particles are Pt (CC3) and Pt—Ru(CC4). In FIG. 3A, a Pt catalyst has a flower shape and a particle diameter of about 150 nm, and is mixed with uniformly distributed fine particles 6 with diameters of more than and less than 100 nanometers. In FIG. 3B, Pt—Ru catalyst particles have a substantially spherical shape, with diameters of about 150 nm. It is believed that aggregation of fine metal particles contributes to formation of larger particles.

Referring to FIG. 4 to FIG. 6, it is found that Pt and Pt—Ru particles 6, deposited on the carbon nanotubes by using ethylene glycol as stabilizer and reduction agent, significantly reduce in size, especially as shown in SEM photos of FIG. 4A to FIG. 4D. Furthermore, the dispersion of the catalyst particles is significantly improved. FIG. 5A to FIG. 5D are photos of transmission electron microscopy (TEM) of FIG. 4. In FIG. 5A to FIG. 5D, the size and dispersion of the Pt and Pt—Ru particles 6 are not significantly changed, compared to a specimen obtained lacking any addition of EG, even at different potentials. FIG. 6 illustrates the distribution of particle diameters of specimens in FIG. 5A to FIG. 5D. It is found that the Pt catalyst has a particle diameter of about 4.48 nm to 9.49 nm, as shown in FIG. 6A and FIG. 6C. The Pt—Ru catalyst has a particle diameter of about 4.80 nm to 5.22 nm, as shown in FIG. 6B and FIG. 6D.

The catalyst of the invention is immersed in a diluted aqueous solution of 0.5 M sulfuric acid and 1.0 M methanol. Then, the performance of the catalyst according to the invention on methanol oxidation is evaluated. CV is used to inspect the methanol oxidation when the catalyst of the invention is present. Furthermore, in order to compare a commercially available Pt—Ru/carbon black as provided by Johnson Matthey (J-M), a specimen similar to the commercially available electrode J-M is prepared as follows as a control for comparison. About 2 mg of commercially available catalyst is mixed with Nafion® diluted solution to form a slurry. The slurry is then applied over a carbon paper (about 1 $cm^2$). Specimens are inspected to determine the catalyst loading by using the inductively coupled plasma-mass spectroscopy. The results are listed in table 1.

TABLE 1

The catalyst loading of Pt and Ru for each specimen estimated by the inductively coupled plasma-mass spectroscopy.

| NO. of specimens | Catalyst loading ($\mu g\ cm^{-2}$) Pt | Ru | Pt:Ru atomic ratio |
|---|---|---|---|
| A01 | 76.3 | — | — |
| A02 | 61.4 | 17.1 | 1:0.54 |
| B01 | 115.1 | — | — |
| B02 | 307.8 | 95.0 | 1:0.59 |
| J-M | 582 | 195.0 | 1:0.65 |

Figure 7A:
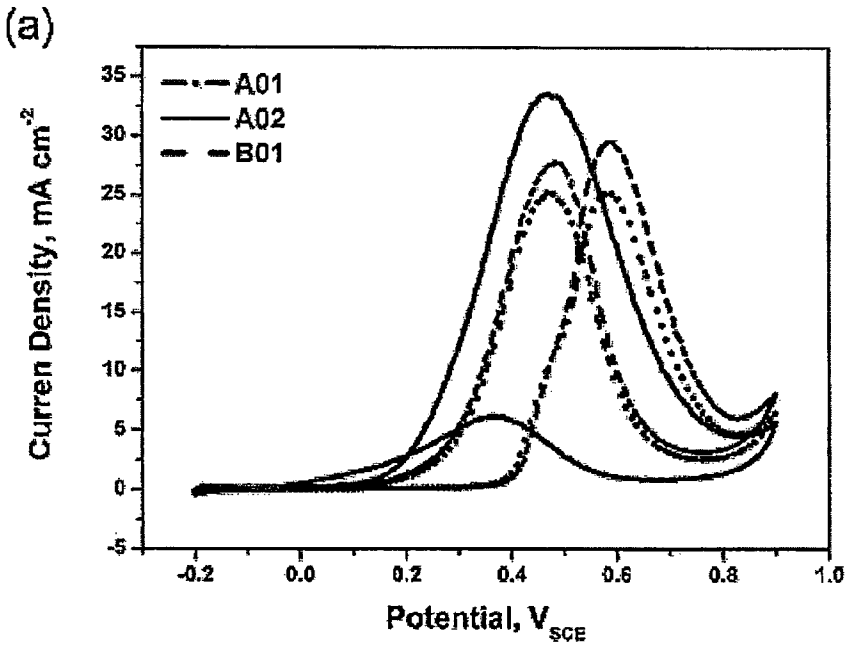
FIG. 7A and FIG. 7B are graphs of CV scanning for oxidization of methanol for A01, A02, B01, B02 and J-M specimens.
Figure 7B:
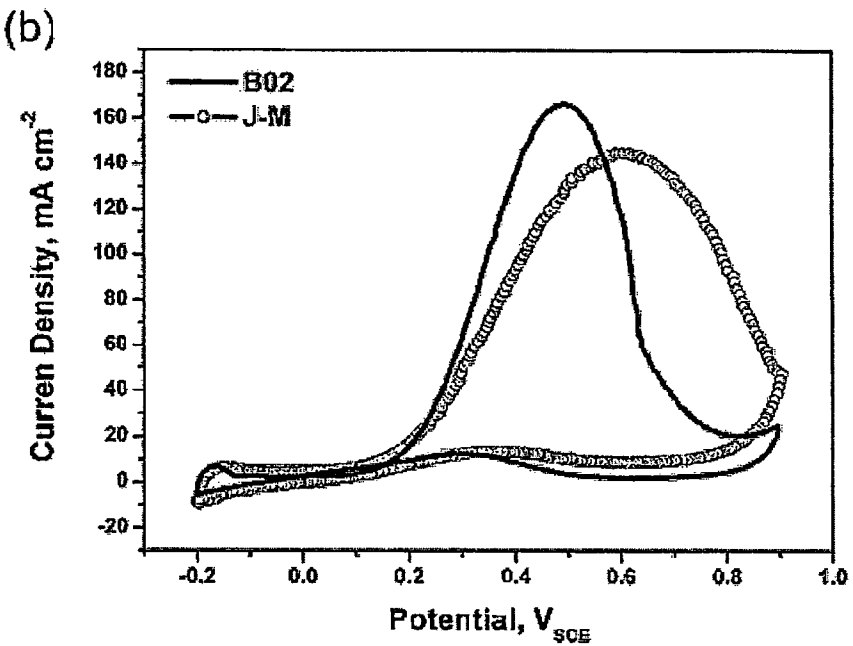

A series of CV tests for characterizing the behavior of methanol oxidation on the A01, A02, B01, B02 and J-M specimens in a mixed electrolyte of 1 M $CH_3OH$+0.5 M $H_2SO_4$ were carried out. The voltammograms of each specimen became stable and similar after the fifth cycle. The results from the fifth cycle are shown in FIG. 7A and FIG. 7B. The voltammograms of A02, B02, and J-M (the ones with Pt—Ru catalysts) were distinctly different from those obtained on A01 and B01 (with Pt catalysts only). All electrochemical characteristic data of the tests are summarized in Table 2. The efficiencies of the specimens on methanol oxidation were compared in items of forward peak current density, the ratio of the forward peak current density ($i_f$) to the reverse peak current density ($i_b$), and the mass activity (MA, peak current density of methanol oxidation obtained from cyclic voltammogram per unit of Pt loading mass), as listed in Table 2. Among the forward peak current densities, B02 exhibited a relatively higher value than the others. The peaks that appeared during the reverse scan signified the desorption of CO generated through methanol oxidation during the forward scan. For A02 B02, and J-M, the CO desorption peak current densities during the reverse scan were significantly lower than those of A01 and B01, indicating that the presence of Ru indeed effectively suppress the adsorption of CO on the Pt surface, which has been interpreted as "CO poisoning". The outcome was consistent with the relatively higher $i_f/i_b$ values of A02 and B02, as also listed in Table 2, highlighting a more efficient CO desorption on these specimens. In general, different deposition potentials did lead to significant changes (33.7% for only Pt treated specimens and 80.1% for Pt—Ru treated specimens) in Pt loading, according to the ICP-MS measurements (Table 1). The impact of deposition potential on the electroactivity of the working specimens with Pt—Ru could be easily identified by examining the 79.9% difference in peak current density for methanol oxidation between A02 and B02. In the meantime, the small difference in the same item between A01 and B01 was mainly due to severe CO poisoning on both specimens.

In order to investigate the effect of Pt loading on methanol oxidation efficiency, calculated MA data were also examined. It was found that the MA values of A02 and B02 were greater than those of the other two specimens. In addition, similarly higher MA values of A02 and B02 implicated that the more negative deposition potential simply increased the Pt loading and consequently led to an increase in the peak current density of methanol oxidation. In other words, the lower deposition potential would not significantly alter the methanol oxidation efficiency of the specimens if the loadings were the same. Further looking into the onset potentials of A02, B02, and J-M (with Pt—Ru catalysts), we found that B02 exhibited the lowest value among these specimens, signifying its superior catalytic activity for methanol oxidation. In summary, the working specimen with Pt—Ru catalysts electrodeposited at −0.45 $V_{SCE}$ proved to be the best electrode for methanol oxidation among the selected specimens. The current outcome can be used to exemplify the benefit of using a mixed ethylene glycol and sulfuric acid aqueous solution as an electrolyte for the electrodeposition of Pt—Ru catalysts on CNT based catalyst supports for direct methanol fuel cell applications.

TABLE 2

Electrochemical characteristics of the specimens during CV analyses.

| No. of specimens | Starting potentials ($V_{SCE}$) | Forward scanning peak potentials ($V_{SCE}$) | Forward scanning peak current density (mA $cm^{-2}$) | Forward scanning current v.s. backward scanning peak current ($i_f/i_b$ ratios) | Mass activity[a] (A $g^{-1}$) |
|---|---|---|---|---|---|
| A01 | 0.386 | 0.58 | 25.2 | 1.0 | 330.3 |
| A02 | 0.193 | 0.47 | 33.6 | 5.44 | 547.2 |
| B01 | 0.373 | 0.59 | 29.5 | 1.06 | 256.3 |
| B02 | 0.172 | 0.49 | 167.0 | 13.36 | 542.6 |
| J–M | 0.139 | 0.65 | 145.0 | 10.66 | 249.1 |

[a]The mass activity is defined as the forward peak current density obtained from the voltammograms (FIG. 7A to FIG. 7B) per unit Pt loading mass listed in Table 1.

The invention aims to break up the bottleneck of it being difficult to narrow down the catalyst particles to nanometer scale in the prior art. With the dispersion of the metal particles 6 of the invention, the benefit to fuel cell catalyst electrodes can be maximized. In order to achieve the above objectives, alcohols such as ethylene glycol, which has been used as reduction agent or stabilizer in the chemical reduction processes, are added into the electrodeposition solution 2. With the use of alcohols in proper concentrations which does not affect the ion conductivity of the electrodeposition solution, the Pt and Pt-based alloy particles 6 deposited on the substrate 3 have appropriate dimensions for narrowing down to nanometer scale and good dispersion.

In view for the foregoing, the electrodeposition solution of Pt and Pt-based alloy nano-particles with addition of ethylene glycol according to the invention provides the following advantages over the prior art.

1. The acidic electrodeposition solution of the invention offers efficient ion conductivity.
2. Ethylene glycol added into the electrodeposition solution of the invention effectively enhances the removal of chlorine from metal chlorides. Meanwhile, ethylene glycol is used as stabilizer to prevent the particles deposited on the substrate 3 from being aggregated and thus increase dispersion of the particles 6.
3. The Pt and Pt-based alloy particles 6 deposited on the substrate 3 have dimensions appropriate for narrowing down to nanometer scale.

It should be apparent to those skilled in the art that the above description is only illustrative of specific embodiments and examples of the present invention. The present invention should therefore cover various modifications and variations made to the herein-described structure and operations of the present invention, provided they fall within the scope of the present invention as defined in the following appended claims.

What is claimed is:

1. An electrodeposition process of platinum-contained nanoparticles with addition of ethylene glycol, comprising providing a reactor;

placing an electrodeposition solution into the reactor, wherein the electrodeposition solution is an acidic solution containing ethylene glycol and at least one platinum-based chloride;

providing an electrically conductive substrate as a cathode and platinum metal as an anode, immersing the cathode and the anode into the electrodeposition solution; and applying a negative potential to deposit platinum-contained nanoparticles on the electrically conductive substrate, the particle size of the nanoparticles is less than 10 nanometer.

2. The process of claim 1, wherein the temperature of the electrodeposition solution is within the range of 18 to 60° C. in the step of applying a negative potential to deposit platinum-contained nanoparticles on the electrically conductive substrate.

3. The process of claim 1, wherein the concentration of ethylene glycol in the electrodeposition solution is within the range of 0.01 M to 5 M.

4. The process of claim 1, wherein the acidic solution is $H_2SO_4$, $HNO_3$, $HClO_4$, HCl, or $CH_3COOH$.

5. The process of claim 1, wherein the concentration of the acidic solution in the electrodeposition solution is within the range of 0.005 M to 10 M.

6. The process of claim 1, wherein the platinum-based chloride in the electrodeposition solution is within the range of 0.1 mM to 100 M.

7. The process of claim 1, further comprising a step of placing a reference electrode into the reactor, wherein the reference electrode is a saturated calomel electrode, a silver/silver chloride electrode or a standard hydrogen electrode.

8. The process of claim 1, wherein the potential is a pulse direct current of 1 VSHE to −2 VSHE (potential versus a standard hydrogen electrode).

9. The process of claim 8, wherein the pulse direct current has a frequency of 0.000001 Hz to 1000000 Hz.

10. The process of claim 1, wherein the potential is non-pulse direct current (constant potential) of −0.00001 VSHE to −2 VSHE (potential versus a standard hydrogen electrode).

11. The process of claim 1, wherein the applying potential time is 1 microsecond to 24 hours.

* * * * *